US009725865B2

(12) United States Patent
Coulon et al.

(10) Patent No.: US 9,725,865 B2
(45) Date of Patent: Aug. 8, 2017

(54) DRIVE POINT FOR A PILE

(71) Applicant: Tiroler Rohre GmbH, Hall in Tirol (AT)

(72) Inventors: Jerome Coulon, Mieming (AT); Hermann Mutschlechner, Rum (AT)

(73) Assignee: TIROLER ROHRE GMBH, Hall in Tirol (AT)

( * ) Notice: Subject to any disclaimer, the term of this patent is extended or adjusted under 35 U.S.C. 154(b) by 28 days.

(21) Appl. No.: 14/509,369

(22) Filed: Oct. 8, 2014

(65) Prior Publication Data

US 2015/0023739 A1 Jan. 22, 2015

Related U.S. Application Data

(63) Continuation of application No. PCT/EP2013/001069, filed on Apr. 12, 2013.

(30) Foreign Application Priority Data

Apr. 20, 2012 (AT) ..... 485/2012

(51) Int. Cl.
*E02D 5/34* (2006.01)
*E02D 5/72* (2006.01)
(Continued)

(52) U.S. Cl.
CPC ..... *E02D 5/72* (2013.01); *E02D 5/38* (2013.01); *E02D 5/665* (2013.01)

(58) Field of Classification Search
CPC .. E02D 5/34; E02D 5/46; E02D 15/04; E02D 27/12; E02D 5/30; E02D 5/808; E02D 7/24
(Continued)

(56) References Cited

U.S. PATENT DOCUMENTS 1,352,128 A * 9/1920 Howell ..... E02D 5/34 173/137
1,366,460 A * 1/1921 Howell ..... E02D 7/26 175/393
(Continued)

FOREIGN PATENT DOCUMENTS

GB 770612 3/1957

OTHER PUBLICATIONS

International Search Report (ISR) issued Sep. 16, 2013 in International (PCT) Application No. PCT/EP2013/001069.
(Continued)

*Primary Examiner* — Benjamin Fiorello
*Assistant Examiner* — Edwin Toledo-Duran
(74) *Attorney, Agent, or Firm* — Wenderoth, Lind & Ponack, L.L.P.

(57) ABSTRACT

A drive point for a substantially tubular, in particular hollow cylindrical, driven pile having a pile core through which concrete can be introduced into the driven pile, wherein the drive point can be fitted onto a pile end of the driven pile, wherein at least one first supporting web with a first contact surface for an end face of the pile end is arranged on an inner wall of the drive point, wherein starting from a plane of a first bearing surface the drive point has a cavity which extends at least partially in a driving direction and into which concrete can be introduced through the pile core when the driven pile is fitted, wherein at least one concrete outlet channel is provided which connects the cavity to an upper edge of the drive point.

20 Claims, 2 Drawing Sheets

(51) Int. Cl.
*E02D 5/38* (2006.01)
*E02D 5/66* (2006.01)

(58) Field of Classification Search
USPC ..... 405/231, 232, 233, 236, 240, 241, 242, 405/248, 249, 252.1
See application file for complete search history.

(56) References Cited

U.S. PATENT DOCUMENTS 1,844,871 A * 2/1932 Schmedes ..... E02D 5/72 405/246
2,016,250 A * 10/1935 Camp ..... F42B 3/10 102/322
2,146,645 A * 2/1939 Newman ..... E02D 5/385 405/239
2,562,860 A * 7/1951 Cobi ..... E02D 5/72 405/253
2,797,466 A * 7/1957 Lidberg ..... E02D 5/665 249/51
3,194,328 A * 7/1965 Fiore ..... E02D 7/28 173/132
3,306,054 A * 2/1967 Dougherty ..... E02D 5/72 405/253
3,333,428 A * 8/1967 Dougherty ..... E02D 5/72 175/414
3,362,171 A * 1/1968 Arpaia ..... E02D 5/44 405/244
3,690,109 A * 9/1972 Turzillo ..... E02D 15/04 405/241
3,763,654 A * 10/1973 Matsushita ..... 405/232
3,783,624 A * 1/1974 Nakade ..... C09K 8/5086 405/264
3,807,184 A * 4/1974 Turzillo ..... E02D 5/36 405/238
3,869,869 A * 3/1975 Pao Chen ..... E02D 5/385 405/240
3,973,409 A * 8/1976 Asayama ..... E02D 5/74 175/292
4,426,175 A * 1/1984 Lin ..... E02D 3/12 405/237
4,673,312 A * 6/1987 Nussbaumer ..... E21B 4/00 175/67
4,685,834 A * 8/1987 Jordan ..... E02D 5/44 405/232
5,018,905 A * 5/1991 Kinder ..... E02D 35/00 405/230
5,833,399 A * 11/1998 Bullivant ..... E02D 5/385 405/233
6,368,021 B1 * 4/2002 Strong ..... E02D 7/28 175/171
6,814,525 B1 * 11/2004 Whitsett ..... E02D 5/38 405/233
6,951,437 B2 * 10/2005 Hall ..... E02D 27/48 405/230
8,602,689 B1 * 12/2013 Van Polen ..... E02D 7/28 175/23
2004/0247397 A1 * 12/2004 Fox ..... E02D 5/46 405/248
2006/0147274 A1 * 7/2006 Ding ..... E02D 5/44 405/237
2006/0263150 A1 * 11/2006 Barrett ..... E02D 3/12 405/259.5
2013/0272799 A1 * 10/2013 Suver ..... E02D 7/00 405/233

OTHER PUBLICATIONS

Austrian Patent Office Search Report (ASR) issued Oct. 18, 2012 in corresponding Austrian Patent Application No. A 485/2012.

* cited by examiner

DRIVE POINT FOR A PILE

BACKGROUND OF THE INVENTION

1. Field of the Invention

The invention concerns a drive point for a substantially tubular, in particular hollow-cylindrical, driven pile having a pile core, through which concrete can be introduced into the driven pile, wherein the drive point can be fitted on to a pile end of the driven pile, wherein at least one first support limb with a first support surface for an end face of the pile end is arranged at an inside wall of the drive point.

2. Description of Related Art

Drive points of that kind are used in the construction industry for making pile foundations. The individual driven piles which generally comprise ductile cast iron and are of predetermined lengths of for example five meters are fitted one into the other to produce a pile foundation. To facilitate inserting driven piles one into each other and thus extending the length of a pile foundation the driven piles usually have a conically tapering first pile end and a second pile end which is shaped to provide a socket. In that way the pile foundation can be driven into the ground pile by pile, whereby it is possible to produce pile foundations of any length quickly and inexpensively. Driven piles of that kind are usually produced in a centrifugal casting process with a shaping rotating mold. That results in substantially cylindrical tubular piles which are internally hollow. Depending on the respective kind of use those hollow-cylindrical driven piles can be filled or encased with concrete or another suitable injection material to produce a stable foundation after having been driven into the ground.

To produce a so-called shaft-grouted pile foundation a drive point is fitted on to the first driven pile, the outside diameter of the drive point being greater than the outside diameter of the driven pile. In that way an annular space can be produced during the driving-in operation, and that space can be filled with the injection material or concrete by a pressure grouting operation. For that purpose, during the driving operation a pumpable concrete mortar which is usually of a grain size of up to 4 mm is conveyed through the hollow pile core of the driven pile to the foot of the pile and pressed into the ground at the drive point. This means that the concrete pressure grouting operation takes place simultaneously with the pile driving operation and is concluded upon the attainment of the final depth of the pile foundation. The shaft grouting operation permits a considerable increase in the useful load of a pile foundation in particular in gravels and sands because a substantially higher level of shaft friction prevails in large-grain grounds between the pressing shaft and the ground, than between the pile tube of an ungrouted driven pile and the ground.

So that the concrete mortar introduced into the pile core of a driven pile can issue from the driven pile and can form a pressed grouting sheathing around the driven pile, it is known in the state of the art for suitable openings to be cut out of the driven pile. That however results in a weakening of the tubular cross-section and thus static instabilities of a pile foundation.

SUMMARY OF THE INVENTION

The object of the invention is to provide an improved drive point with which pile foundations can be produced, while avoiding the above-described disadvantages.

According to the invention that object is attained by the features of claim 1. Advantageous configurations of the invention are recited in the appendant claims.

According to the invention therefore it is provided that starting from the plane of the first support surface the drive point has a cavity which extends at least partially in the driving-in direction and into which concrete can be introduced through the pile core when the driven pile is fitted on, wherein there is provided at least one concrete outlet passage which connects the cavity to an upper edge of the drive point.

In that way, during the driving-in operation, concrete mortar or another suitable injection material can be introduced into the annular space between the outside diameter of the drive point and the outside diameter of the driven pile without appropriate openings or incisions having to be made for that purpose in the casing of the driven pile. In other words, when using a drive point according to the invention, the driven pile does not have to be manipulated at all, whereby there is also no unwanted weakening of the tubular cross-section of the driven pile.

In a particularly preferred embodiment the drive point at least partially and preferably completely comprises cast iron and is of a substantially rotationally symmetrical outside shape, the axis of rotation extending substantially in the driving-in direction. If an outside diameter of the drive point substantially continuously decreases in the driving-in direction it is then possible for a pile foundation to be particularly easily driven in, with the use of a proposed drive point. Self-evidently however it can also be provided that the outside diameter of the drive point is substantially constant along its extent in the driving-in direction.

As generally hollow-cylindrical driven piles are used, an advantageous development of the invention provides that the at least one first support limb in the cross-section relative to the driving-in direction is in the form of a segment of a circle or a segment of a circular ring. It is desirable in that respect if a circular arc of the segment of the circle or circular ring extends over less than 340°, preferably over between 40° and 120°, particularly preferably over between 70° and 90°.

In a particularly preferred variant it can be provided that there is provided a plurality of concrete outlet passages, preferably three concrete outlet passages. Preferably in that case two respective concrete outlet passages of the plurality of concrete outlet passages are arranged in the cross-section relative to the driving-in direction along the inside wall of the drive point substantially at equal spacings relative to each other. Self-evidently the concrete outlet passages can also be so arranged along the inside wall of the drive point that they are at irregular spacings relative to each other.

For centering the driven pile and/or for positionally stable fixing thereof at least one radially inwardly projecting supporting device can be provided at the inside wall. In that case preferably the at least one radially inwardly projecting supporting device can be in the form of a plurality of supporting ribs.

To be able to provide a universally useable drive point for a plurality of driven piles of different outside diameters it can be provided in a preferred variant that arranged at the inside wall of the drive point is at least one second support limb with a second support surface for an end face of a pile end, wherein the spacing of the second support surface from the edge of the drive point in the driving-in direction is greater than the spacing of the first support surface from the edge of the drive point. It is however also possible for the first and second support surfaces to be in the same plane. Generally the first and second support surfaces can preferably be in a plane parallel to a cross-sectional plane transversely relative to the driving-in direction E.

A particularly advantageous embodiment of the invention is that in which the drive point is in one piece. It will be appreciated however that it is also possible for the drive point to be of a multi-part configuration.

BRIEF DESCRIPTION OF THE DRAWINGS

Further details and advantages of the present invention are described by means of the specific description hereinafter. In the drawing.

DETAILED DESCRIPTION OF THE INVENTION

Figure 1A:
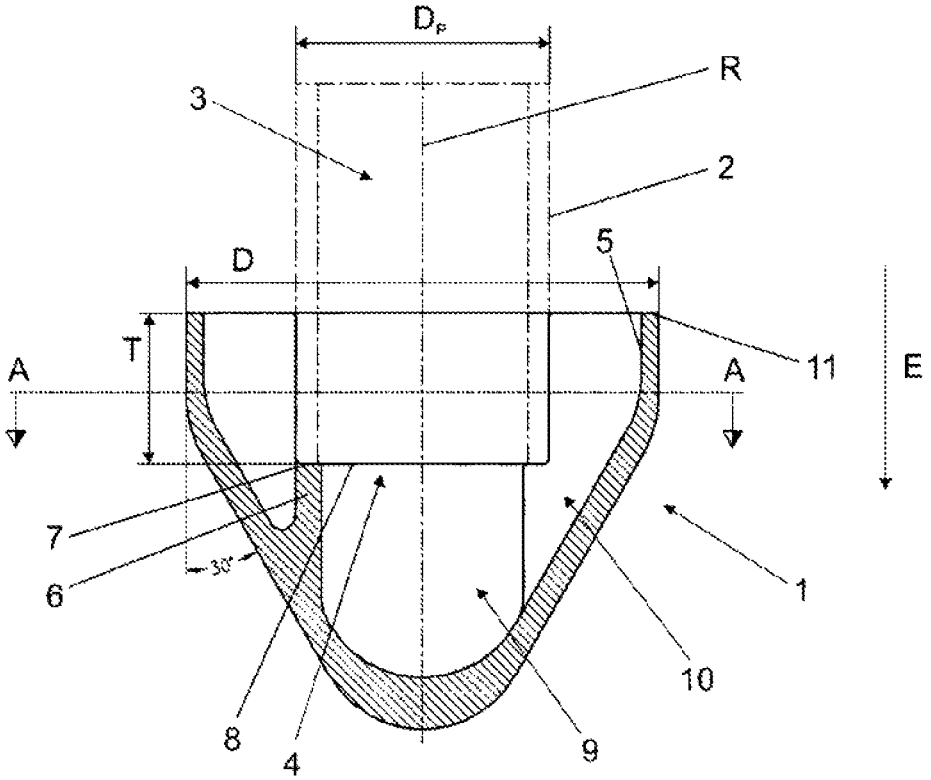
FIG. 1*a* shows a longitudinal section through a proposed drive point along the driving-in direction.
Figure 1B:
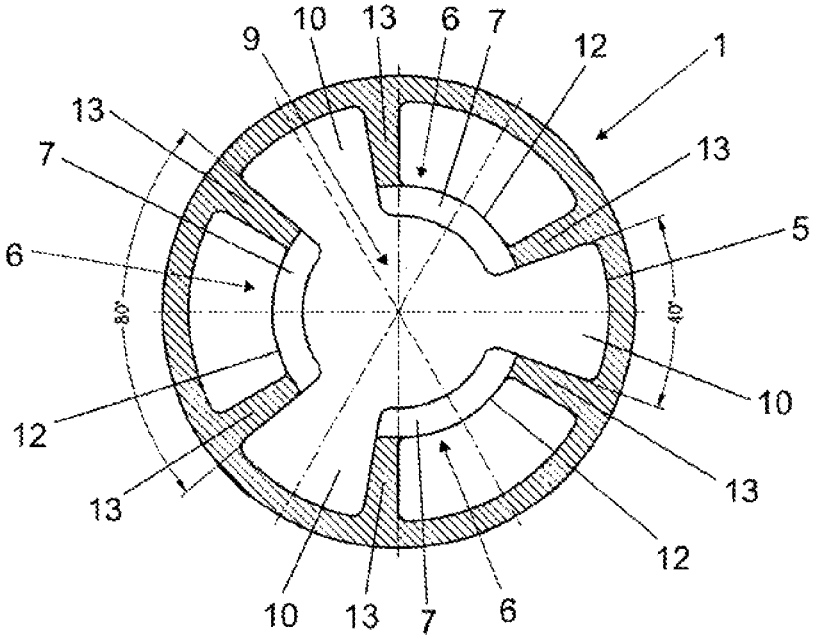
FIG. 1*b* shows a cross-section taken along section line A-A through the drive point of FIG. 1*a*.

FIG. 1*a* shows a longitudinal section through a proposed drive point 1 along a driving-in direction E and FIG. 1*b* shows a cross-section along section line A-A. In this example the drive point 1 is of a one-part structure and comprises ductile cast iron. The external shape of the drive point 1 is rotationally symmetrical in relation to the axis of rotation R. At an upper edge 11 the drive point 1 is of an outside diameter D greater than an outside diameter $D_P$ of a fitted-on driven pile 2. In the driving-in direction E the outside diameter D of the drive point 1 decreases in a frustoconical configuration in the direction of its end, thereby making it easier to drive in a pile foundation with fitted drive point 1.

Projecting from the inside wall 5 of the drive point 1 in opposite relationship to the driving-in direction E are a plurality of first support limbs 6 which each have a first support surface 7. The first support surfaces 7 of the first support limbs 6 are disposed in this case in one plane and in total form a defined abutment for the end face 8 of a pile end 4 of a fitted-on driven pile 2. That defined abutment provides that the driven pile 2 can be fitted on to the drive point 1 in the driving-in direction E to such an extent until the end face 8 of the driven pile 2 bears against the first support surfaces 7 of the first support limbs 6. The maximum depth of insertion engagement of the driven pile 2 in the driving-in direction E is afforded by the spacing T from the upper edge 11 of the drive point 1 to the plane of the first support surfaces 7.

Starting from the plane of the first support surfaces 7 provided in the drive point 1 is a cavity 9 extending in the driving-in direction E. In this example three concrete outlet passages 10 are provided between the cavity 9 and the upper edge 11 of the drive point 1. That makes it possible for concrete mortar which is introduced through the pile core 3 of the driven pile 2 and which penetrates into the cavity 9 by way of the end face 8 to pass in production of a pile foundation by way of the concrete outlet passages 10 to the outside wall of the driven pile 2, thus permitting the production of a shaft pressure grouting.

FIG. 1*b* shows a cross-section along line A-A in FIG. 1*a* through the drive point 1 of FIG. 1*a*. It can be clearly seen from this view that the abutment for the end face 8 of the driven pile 2, which is arranged at the spacing T from the upper edge 11 of the drive point 1 in the driving-in direction E, is formed by a total of three first support surfaces 7. In this case each of the three first support limbs 6 is in the form of a segment of a circular ring in a cross-section relative to the driving-in direction E. In this case the circular arc 12 of each segment of the circular ring extends over a respective angular range of 80° and the three circular arcs 12 are arranged distributed uniformly along a notional circle.

A concrete outlet passage 10 is arranged between two respective first support limbs 6. In this case two respective concrete outlet passages 10 are arranged substantially at equal spacings relative to each other along the inside wall 5 of the drive point 1. Each concrete outlet passage 10 extends over an angle range of 40° along the inside wall 5. A plurality of supporting ribs are arranged as supporting devices 13 at the inside wall 5 for centering the driven pile 2 and/or for positionally stable fixing thereof.

Figure 2A:
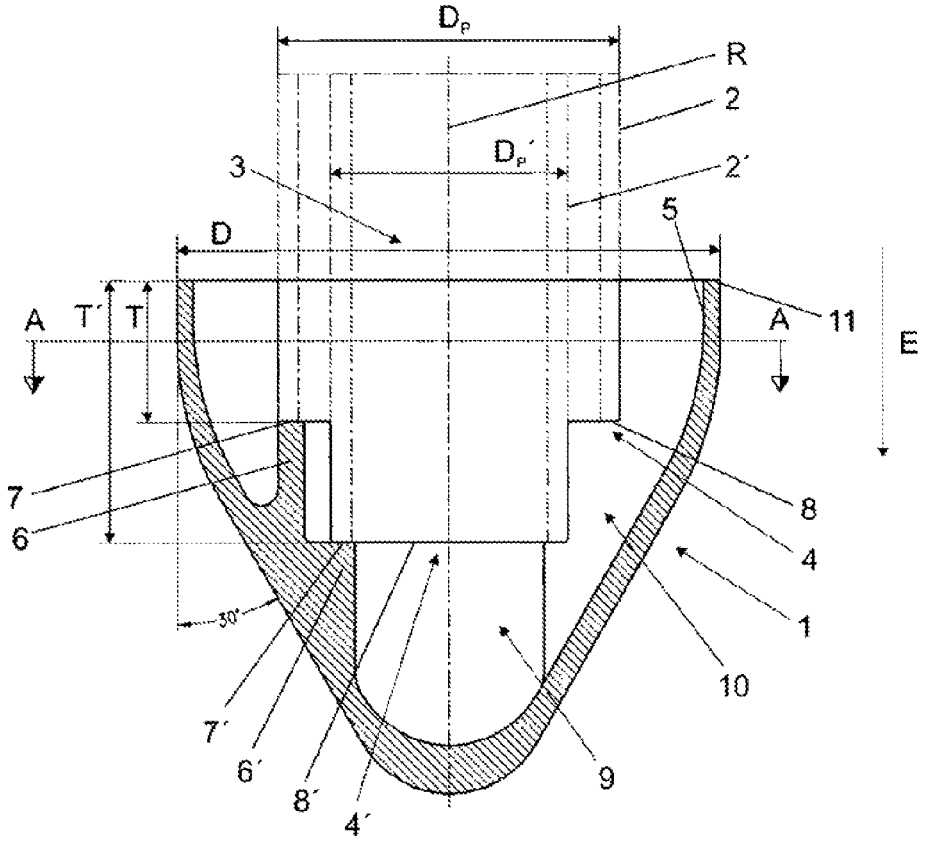
FIG. 2*a* shows a longitudinal section of a further proposed drive point with two different support surfaces for two driven piles of different outside diameters.

FIG. 2*a* shows a possible development of the drive point 1 of FIG. 1*a*. Besides first support limbs 6 for a first driven pile 2 this embodiment additionally has second support limbs 6' for a second driven pile 2' of a different outside diameter $D_P'$ relative to the driven pile 2. Each second support limb 6' has a second support surface 7', wherein the total of the second support surfaces 7' forms a defined abutment for the end face 8' of the second driven pile 2'. In the driving-in direction E the spacing T' of the second support surfaces 7' from the edge 11 of the drive point 1 is greater than the spacing T of the first support surfaces 7 from the edge 11 of the drive point 1. It will be appreciated that it will also be possible for both support surfaces 7, 7' to be in the same plane. In that case it would only be necessary for the width of a support surface 7, 7' in the radial direction to be selected to be of such a size that it is suitable for the entire band width of the outside diameters $D_P$, $D_P'$ of the driven piles 2, 2' to be employed.

Figure 2B:
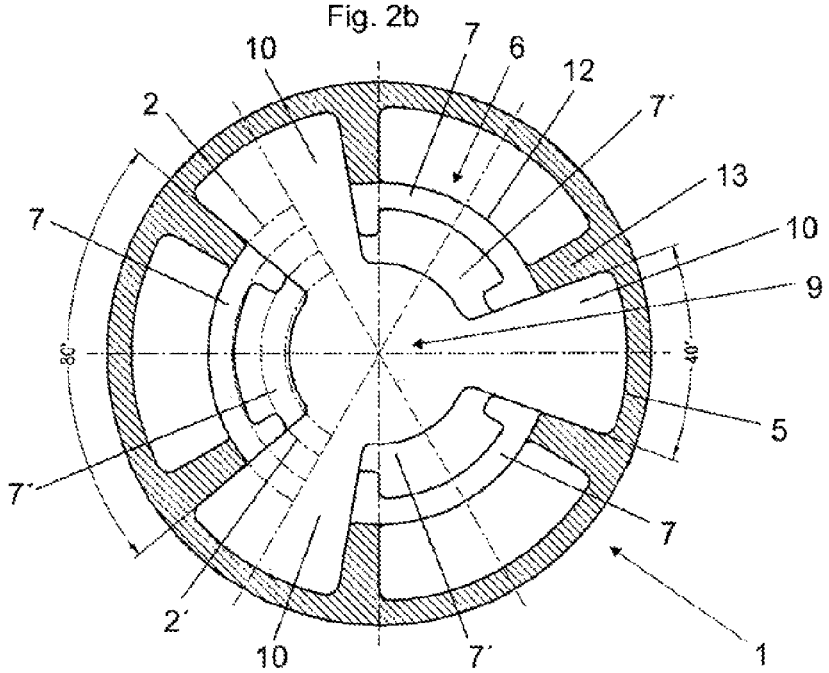
FIG. 2*b* shows a cross-section taken along section line A-A through the driven pile of FIG. 2*a*.

FIG. 2*b* shows the drive point 1 of FIG. 2*a* in a cross-sectional view along section line A-A. It is to be seen in this respect that the support surfaces 7, 7' corresponding to the different outside diameters $D_P$, $D_P'$ of the driven piles 2, 2' are of a different radial spacing relative to the axis of rotation R of the drive point 1. The structural configuration of the illustrated drive point 1 however is otherwise similar to the drive point 1 in FIG. 1*b*.

The invention claimed is:

1. A drive point for a substantially tubular, driven pile having a pile core, through which concrete can be introduced into the driven pile, wherein the drive point can be fitted onto a pile end of the driven pile, wherein at least one first support limb with a first support surface configured to abut an end face of the pile end of the driven pile is arranged at an inside wall of the drive point, wherein, starting from a plane of the first support surface, the drive point has a cavity which extends at least partially in a driving-in direction and into which the concrete can be introduced through the pile core when the driven pile is fitted onto the pile end of the driven pile, wherein at least one concrete outlet passage is arranged along the inside wall of the drive point and, in a state in which the drive point is driven in the driving-in direction, connects the cavity to an upper edge of the drive point opposite to a tip of the drive point, the tip of the drive point extending in the driving-in direction, and wherein the end face of the pile end of the driven pile is located at a circumferential edge of the driven pile and the at least one first support limb is configured to extend from the circumferential edge of the driven pile such that the at least one first support limb is offset from a central axis of the driven pile.

2. The drive point as set forth in claim 1, wherein the drive point has a substantially rotationally symmetrical external shape, wherein an axis of rotation extends substantially in the driving-in direction.

3. The drive point as set forth in claim 1, wherein the at least one first support limb in a cross section relative to the driving-in direction is a segment of a circle or a segment of a circular ring.

4. The drive point as set forth in claim 3, wherein a circular arc of the segment of the circle or the circular ring extends over less than 340°.

5. The drive point as set forth in claim 4, wherein the circular arc of the segment of the circle or the circular ring extends over between 40° and 120°.

6. The drive point as set forth in claim 5, wherein the circular arc of the segment of the circle or the circular ring extends over between 70° and 90°.

7. The drive point as set forth in claim 1, wherein the at least one concrete outlet passage is one of a plurality of concrete outlet passages.

8. The drive point as set forth in claim 7, wherein the plurality of concrete outlet passages is three concrete outlet passages.

9. The drive point as set forth in claim 7, wherein two concrete outlet passages of the plurality of concrete outlet passages are arranged in a cross section relative to the driving-in direction along the inside wall of the drive point substantially at equal spacings relative to each other.

10. The drive point as set forth in claim 1, wherein at least one radially inwardly projecting supporting device is provided at the inside wall of the drive point for centering the driven pile and/or for positionally stable fixing thereof.

11. The drive point as set forth in claim 10, wherein the at least one radially inwardly projecting supporting device is a plurality of supporting ribs.

12. The drive point as set forth in claim 1, wherein at least one second support limb with a second support surface for an end face of another pile end is arranged at the inside wall of the drive point, wherein a spacing of the second support surface from the upper edge of the drive point in the driving-in direction is greater than a spacing of the first support surface from the upper edge of the drive point.

13. The drive point as set forth in claim 1, wherein an outside diameter of the drive point substantially continuously decreases in the driving-in direction.

14. The drive point as set forth in claim 1, wherein the drive point is in one piece.

15. The drive point as set forth in claim 1, wherein the drive point comprises cast iron.

16. The drive point as set forth in claim 1, wherein the drive point and the first support limb are in one piece.

17. The drive point as set forth in claim 1, wherein a tip of the drive point is arcuate.

18. The drive point as set forth in claim 1, wherein the drive point is continuous from a first terminal end of the drive point to a second terminal end of the drive point.

19. The drive point as set forth in claim 1, wherein the first support limb extends in the driving-in direction.

20. The drive point as set forth in claim 1, wherein the drive point consists of cast iron.

* * * * *